US008233014B2

(12) United States Patent
Chiou et al.

(10) Patent No.: US 8,233,014 B2
(45) Date of Patent: Jul. 31, 2012

(54) COLOR SEQUENTIAL DISPLAY AND POWER SAVING METHOD THEREOF

(75) Inventors: Shian-Jun Chiou, Taipei (TW); Wen-Chih Tai, Hsinchu County (TW); Chi-Neng Mo, Taoyuan County (TW); Chia-Lin Liu, Taichung County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 458 days.

(21) Appl. No.: 12/686,384

(22) Filed: Jan. 13, 2010

(65) Prior Publication Data

US 2011/0063333 A1 Mar. 17, 2011

(30) Foreign Application Priority Data

Sep. 15, 2009 (TW) ..... 98131034 A

(51) Int. Cl.
*G09G 5/10* (2006.01)

(52) U.S. Cl. ..... 345/690; 345/212

(58) Field of Classification Search ..... 345/87–98, 345/204–215, 690
See application file for complete search history.

(56) References Cited

FOREIGN PATENT DOCUMENTS

| | | | |
|---|---|---|---|
| CN | 1400576 | A | 3/2003 |
| CN | 101447175 | A | 6/2009 |
| EP | 1280129 | A2 | 1/2003 |
| JP | 683501 | A | 3/1994 |
| JP | 200329720 | A | 1/2003 |
| JP | 200344011 | A | 2/2003 |
| JP | 2003162261 | A | 6/2003 |
| JP | 2003195820 | A | 7/2003 |
| JP | 2003248463 | A | 9/2003 |
| JP | 20099116 | A | 1/2009 |
| WO | 0191098 | A1 | 11/2001 |
| WO | 2006030868 | A1 | 3/2006 |

*Primary Examiner* — Vijay Shankar
(74) *Attorney, Agent, or Firm* — Winston Hsu; Scott Margo

(57) ABSTRACT

For further reducing power consumption of a color sequential display, a frame rate or a field rate is reduced according to conditions, which include whether a received frame is dynamic or static and whether a backlight mode is activated, for reducing power consumption. Besides, images may be outputted in forms of color images or of grey levels selectively so as to reduce an amount of processed data and related data transmission.

26 Claims, 5 Drawing Sheets

COLOR SEQUENTIAL DISPLAY AND POWER SAVING METHOD THEREOF

BACKGROUND OF THE INVENTION

1. Field of the Invention

The present invention discloses a color sequential display and a power saving method thereof, and more particularly, to a color sequential display of determining how to reduce a frame rate and whether to output images in forms of color images or gray level images according to whether a backlight mode of the color sequential display is activated or whether the received frame is static or dynamic.

2. Description of the Prior Art

While a conventional color sequential display displays a frame having many pixels, sub-pixels corresponding to different colors in each pixel are separated. With the aid of a color sequential timing controller, sub-pixels are switched in accordance with different colors, by taking advantage of visual residue, rapid switches of displayed sub-pixels of different colors are not observed by naked eyes, where the color sequential timing controller is used for controlling a displaying timing of pixels on the display panel of the color sequential display. A conventional color sequential display is not equipped with a color filter so that a transmittance of the display panel may be raised; however, sub-pixels corresponding to fields of different colors have to be outputted exclusively and sequentially in timing under a condition that without using a color filter, so that the purpose of displaying full-color frames may be achieved by taking advantages of visual residue. For rapidly transmitting images in forms of color images by a conventional color sequential display, a bus is required to be disposed between an image processing terminal and a color sequential timing controller so as to provide a wide transmission bandwidth, and therefore, scheduled sub-pixels may be rapidly displayed on a display panel under control of the color sequential timing controller. Besides, a frame may be static or dynamic. Under vision of an observer of the conventional color sequential display, a static frame and a dynamic frame differ in a degree of variation within a certain time interval, i.e., a variation rate of the frame, where the dynamic frame brings a higher variation rate, and the static frame brings a lower variation rate or be close to be invariant within the certain time interval. If certain image quality of the color sequential display has to be maintained without brining higher power consumption, frame rates of static frames and dynamic frames have to be different in degree, where a static frame requires a lower frame rate, whereas a dynamic frame requires a higher frame rate.

SUMMARY OF THE INVENTION

The claimed invention discloses a power saving method for a color sequential display. The power saving method comprises determining whether a frame received by an image processing terminal of the color sequential display is static or dynamic; determining whether the color sequential display activates a backlight mode; and reducing a first frame rate used by a graphics engine of the image processing terminal, and reducing a second frame rate of the color sequential display in outputting frames, according to a result of whether the frame is static or dynamic and whether the backlight mode is activated.

The claimed invention discloses a color sequential display. The color sequential display comprises an image processing terminal and a displaying terminal. The image processing terminal comprises an image status detecting unit and a frame rate controlling unit. The image status detecting unit is used for detecting whether an image received by the color sequential display is static or dynamic. The frame rate controlling unit is used for reducing a first frame rate of a graphics engine comprised by the color sequential display according to a result of detecting the image by the image status detecting unit and according to whether the color sequential display activates a backlight mode. The displaying terminal comprises an image input/output controlling unit and a drive controlling unit. The image input/output controlling unit is used for reducing a second frame rate in loading images, according to the first frame rate and according to whether the color sequential display activates the backlight mode. The drive controlling unit is used for controlling timings of a data driving unit, a scan driving unit, and alight emitting diode driving unit comprised by the color sequential display, according to the images load by the image input/output controlling unit. Both the data driving unit and the scan driving unit are used for controlling how pixels on a panel comprised by the color sequential display are displayed, and the light emitting diode driving unit is used for controlling whether a backlight mode of a backlight module comprised by the color sequential display is activated.

The claimed invention discloses a power saving method of a color sequential display. The power saving method comprises determining whether a frame received by an image processing terminal comprised by the color sequential display is static or dynamic; determining whether the color sequential display activates a backlight mode or not; transforming images of the received frame into a plurality of sub-pixel groups, each of which corresponds to a different color; and respectively reducing a field rate of transmitting each of the plurality of sub-pixel groups by the image processing terminal, according to a result of determining the frame is static or dynamic and according to a result of determining whether the color sequential display activates the backlight mode or not.

The claimed invention discloses a color sequential display. The color sequential display comprises an image status detecting unit, a field rate controlling unit, an uni-color image outputting unit, and a color-to-gray-level transforming unit. The image status detecting unit is used for detecting whether a frame received by the color sequential display is static or dynamic. The field rate controlling unit is used for respectively reducing a field rate for transmitting each of a plurality of sub-pixel groups by an image processing terminal, according to a result of detecting the frame by the image status detecting unit. The uni-color image outputting unit is used for transmitting images of the frame into a plurality of sub-pixel groups, and outputting the plurality of sub-pixel groups according to a predetermined color sequence, while the color sequential display activates a backlight mode. The color-to-gray-level transforming unit is used for selectively transforming the plurality of sub-pixel groups from forms of color images into forms of gray level images, and for outputting the plurality of transformed sub-pixel groups according to the predetermined color sequence, while the color sequential display does not activate the backlight mode. Images outputted by the uni-color image outputting unit and the color-to-gray-level transforming unit are received and transmitted by a bus.

These and other objectives of the present invention will no doubt become obvious to those of ordinary skill in the art after loading the following detailed description of the preferred embodiment that is illustrated in the various figures and drawings.

DETAILED DESCRIPTION

The present invention discloses some power saving method for a color sequential display and related color sequential displays. In comparison to a conventional color sequential display, the color sequential displays disclosed in the present invention may reduce power consumption and transmission bandwidths to a further degree. Besides, applying the power saving method and the related color sequential displays on portable color sequential displays, a usage cycle of the portable color sequential display may be extended further since power consumption is reduced. In the power saving method and the related color sequential displays disclosed in the present invention, a first frame/field rate, which is used for transmitting images from an image processing terminal to a displaying terminal of the color sequential display, and a second field rate, which is used for loading images from a buffer by the displaying terminal, are forced to be reduced to critical frame/field rates of different degrees or below, according to whether a received frame is static or dynamic or according to whether a backlight mode of the color sequential display is activated or not, for reducing power consumption and transmission bandwidth, Note that the first frame rate is used by the image processing terminal in transmitting images, the first field rate is corresponding to a specific color (i.e., field) in a transmitted frame and used by the image processing terminal, and the second field rate is used by the displaying terminal in loading images corresponding to a specific color. Besides, whether the backlight mode is activated is also considered to determine transmitting and displaying images in forms of color images or gray level images so as to reduce processed data.

Figure 1:
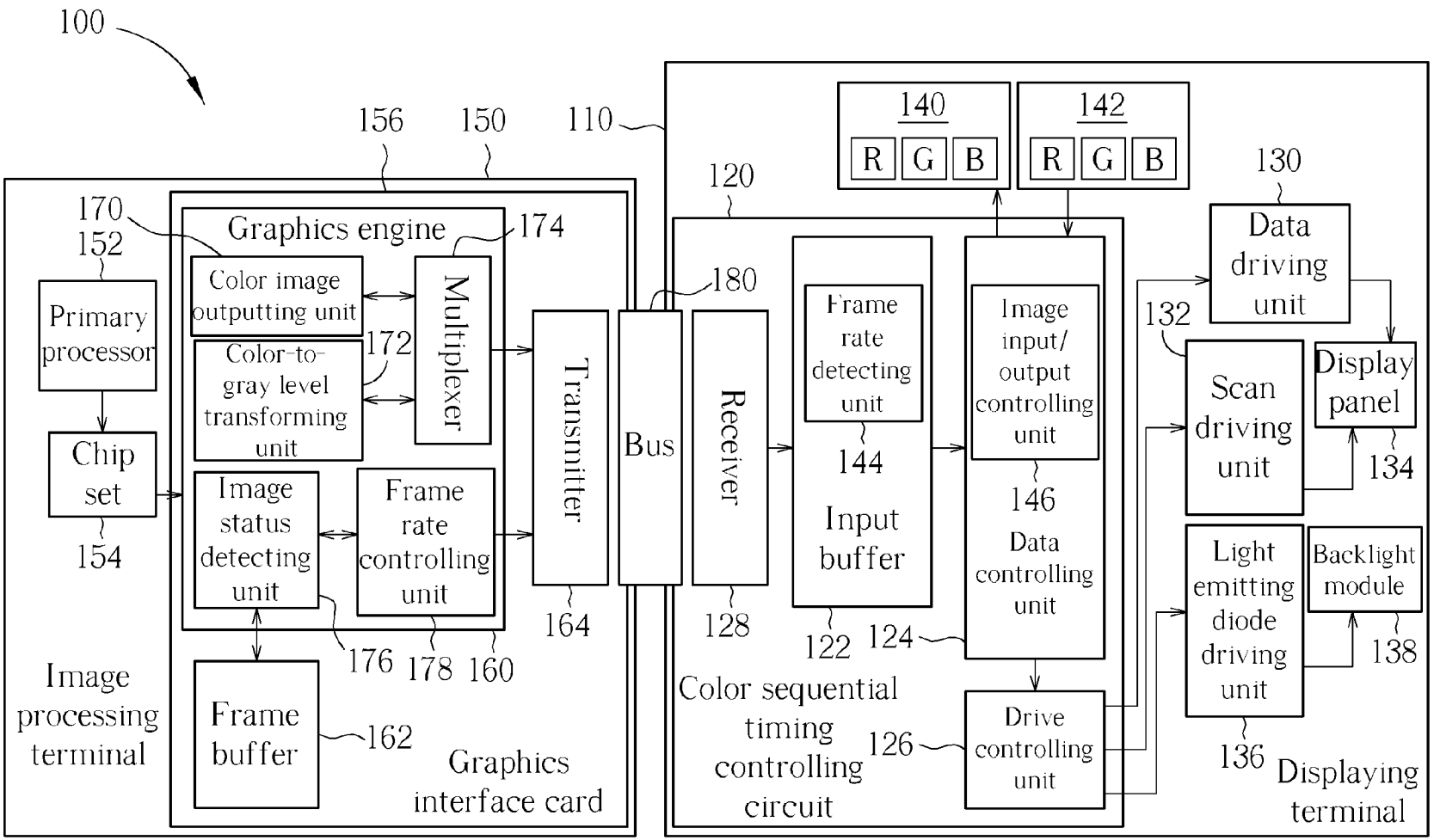
FIG. 1 is a diagram of a color sequential display according to a first embodiment of the present invention.

Please refer to FIG. 1, which is a diagram of a color sequential display 100 according to a first embodiment of the present invention. As shown in FIG. 1, the color sequential display 100 includes a displaying terminal 110 and an image processing terminal 150. The displaying terminal 110 is electrically connected with the image processing terminal 150 through a bus 180 so as to transmit images or control signals, which include clock signals or synchronous signals, between the image processing terminal 150 and the displaying system terminal 110.

The image processing terminal 150 includes a primary processor 152, a chip set 154, and a graphics interface card 156. The primary processor 152 and the chip set 154 are used for cooperating to perform required image processes related to the graphics interface card 156 or to generate frames to the graphics interface card 156. The graphics interface card 156 includes a graphics engine 160, a frame buffer 162, and a transmitter 164. The graphics engine 160 is used for processing images according to the frame received by the graphics interface card 156. The frame buffer 162 is used for buffering required data or signals during processing of the graphics engine 160. The transmitter 164 is used for transmitting required images, which are required by the displaying terminal 110 and outputted from the graphics engine 162, through the bus 180.

The graphics engine 160 includes a color image outputting unit 170, a color-to-gray-level transforming unit 172, a multiplexer 174, an image status detecting unit 176, and a frame rate controlling unit 178. The color image outputting unit 170 is used for outputting images in forms of color images. The color-to-gray-level transforming unit 172 is used for transforming images in forms of from color images into gray level images. The multiplexer 174 is used for determining outputting images in forms of color images from the color image outputting unit 170 or outputting images in forms of gray level images from the color-to-gray-level transforming unit 172, according to certain commands. The image status detecting unit 176 is used for detecting whether a frame received by the color sequential display 100 is static or dynamic, where the received image is generated under the cooperation of the primary processor 152 and the chip set 154. The frame rate controlling unit 178 is used for controlling a first frame rate FR1, which is used for transmitting images by the graphics engine 160, according to a result of detecting the frame by the image status detecting unit 176.

The displaying terminal 110 includes a color sequential timing controller 120, a data driving unit 130, a scan driving unit 132, a display panel 134, a light emitting diode driving unit 136, a backlight module 138, a first buffer 140, and a second buffer 142. The data driving unit 130 and the scan driving unit 132 are used for activating specific transistors included by the display panel 134, so as to display pixels corresponding to the activated specific transistors. The light emitting diode driving unit 136 is used for driving a plurality of light emitting diodes of the backlight module 138, for providing backlights while the color sequential display 100 activates the backlight mode.

The color sequential timing controller 120 is used for controlling the data driving unit 130, the scan driving unit 132, and the light emitting diode driving unit 134, so as to control timings of transistors or light emitting diodes on the display panel 134. The buffers 140 and 142 are used for buffering sub-pixels load or written by the color sequential timing controller 120. The color sequential timing controller 120 includes an input buffer 122, a data controlling unit 124, a drive controlling unit 126, and a receiver 128. The receiver 128 is used for receiving transmitted images or signals from the bus 180. The input buffer 122 is used for synchronizing images, which inputted by the graphics engine 160, a synchronous signal, which is inputted externally with respect to the color sequential timing controller 110, and a system clock, which is used by the color sequential timing controller 110. Besides, the input buffer 122 also classifies and sorts pixels of images from the graphics engine 160 into different sub-pixel groups, each of which corresponds to a unique color. In a preferred embodiment of the present invention, sub-pixels displayed by the color sequential display 100 may includes red sub-pixels, green sub-pixels, and blue sub-pixels. The input buffer 122 includes a frame rate detecting unit 144, for detecting a first frame FR1 controlled by the frame rate controlling unit 178. The data controlling unit 124 includes an image input/output controlling unit 146, for cooperating with the buffers 140 and 142, for reducing a second frame rate FR2, which is used for loading the buffers 140 and 142, according to the first frame rate FR1, and for further controlling image writings of the buffers 140 and 142. The drive controlling unit 126 is used for controlling timings of the data driving unit 130, the scan driving unit 132, and the light emitting diode driving unit 136, according to images load by the image input/output controlling unit 146. Note that the first frame rate FR1 must be higher than the second frame rate FR2, since images transmitted from the image processing terminal 150 and to the displaying terminal 110 has to be buffered in advance and be outputted later under control of the drive controlling unit 126 so that a lower frame rate is required during buffering the images.

The power saving method applied on the color sequential display 100 shown in FIG. 1 is described as follows. While the primary processor 152 and the chip set 154 generates a frame on the graphics engine 160, the image status detecting unit 176 detects whether the frame is a static or a dynamic frame, then the frame rate controlling unit 178 controls the first frame rate FR1 used by the graphics engine 160 according to a result of detecting the frame by the image status detecting unit 176.

The frame rate controlling unit 178 controls the first frame rate FR1 according to the following rules: (1) Reduce the first frame rate FR1 to a first image processing critical frame rate FR1_1, while the frame is dynamic and when the color sequential display 100 activates the backlight mode; (2) Reduce the first frame rate FR1 to a second image processing critical frame rate FR1_2 or below, while the frame is dynamic and when the color sequential display 100 does not activate the backlight mode; and (3) Reduce the first frame rate FR1 to a third image processing critical frame rate FR1_3, while the frame is static. Note that the first image processing critical frame rate FR1_1 is higher than the second image processing critical frame rate FR1_2, and the second image processing critical frame rate FR1_2 is higher than a third image processing critical frame rate FR1_3. Both the first and second image processing critical frame rates FR1_1 and FR1_2 are higher than zero, and the third image processing critical frame rate FR1_3 is not less than zero. While the frame rate FR1 is less than an image processing critical frame rate mentioned above under a corresponding one of the above-mentioned three conditions, defects, such as flickers, may be introduced on displayed images.

Under the first condition that the frame is dynamic and the color sequential display activates the backlight mode, a higher frame rate is required to maintain quality of displaying the dynamic frame above a qualified degree, so that the first image processing critical frame rate FR1_2 is the highest among the above-three image processing critical frame rates. Under the second condition, the frame is dynamic, and the color sequential display 100 does not activate the backlight mode, the image processing critical frame rate FR1_2 may be slightly lower than the image processing critical frame rate FR1_1 without reducing the quality of displaying the dynamic frame. A frame rate lower than the second image processing critical frame rate FR1_2 may also be applied, since flickers, which are introduced under an insufficient frame rate, may not be observable since backlights are not provided at this time. Under the third condition, the frame is static, and the third image processing critical frame rate FR1_3, which is lowest among the three image processing critical frame rates, is used no matter the backlight mode is activated, since displaying static frames does not require a higher frame rate to maintain the displaying quality. However, while the displaying terminal 110 continuously loads fixed images into the buffer 140 or 142, the third image processing critical frame rate FR1_3 may be 0 Hz. Both the first and second image processing critical frame rates FR1_1 and FR1_2 are higher than zero since a frame rate for transmitting dynamic frames cannot be zero for preventing a loss of quality in displaying the dynamic frames.

Besides, when the color sequential display 100 does not activate the backlight mode, the multiplexer 174 is responsible for selectively outputting frames in forms of color images from the color image outputting unit 170 or outputting frames in forms of gray level images from the color-to-gray-level transforming unit 172, which transforms images in forms of from color images into gray level images. While the color sequential display 100 outputs frames having color images, since the first frame rate FR1 has been reduced, a certain degree of power consumption has been saved. However, while the color sequential display 100 outputs frames having gray level images, since data of a gray level image is less than data of a color image in outputting the frames, a transmission rate of the image processing terminal 150 may be allowed to be reduced so that the power consumption may be further saved in the present invention.

Image input/output controlling unit 146 controls the second frame rate FR2 according to the followings: (1) Reduce the second frame rate FR2 to a first displaying critical frame rate FR2_1, while a received frame is dynamic and when the color sequential display 100 activates the backlight mode; (2) Reduce the second frame rate to a second displaying critical frame rate FR2_2 or below, while the frame is dynamic and when the color sequential display 100 does not activate the backlight mode; (3) Reduce the second frame rate FR2 to a third displaying critical frame rate FR2_3, while the frame is static and when the color sequential display 100 activates the backlight mode; (4) Reduce the second frame rate FR2 to a fourth displaying critical frame rate FR2_4, while the frame is static and when the color sequential display 100 does not activate the backlight mode. The first displaying critical frame rate FR2_1 is higher than the second, third, fourth displaying critical frame rate FR2_2, FR2_3, and FR2_4. Both the second and third displaying critical frame rate FR2_2 and FR2_3 are higher than the fourth displaying critical frame rate FR2_4, which is higher than zero.

Note that the displaying critical frame rates mentioned above are used for loading images from the buffers 140 or 142 by the image input/output controlling unit 146, and for transmitted the load images to the drive controlling unit 126 so as to display the images. The first displaying critical frame rate FR2_1 is higher than the second displaying critical frame rate FR2_2, since a higher frame rate is required while the backlight mode is activated. The first displaying critical frame FR2_1 is higher than the third displaying critical frame rate FR2_3, since processing a dynamic frame requires a higher frame rate than processing a static frame. As can be inducted from the above descriptions, the fourth displaying critical frame rate FR2_4 for outputting images to the display panel 134 is lower than both the second and third displaying critical frame rates FR2_2 and FR2_3, since the fourth displaying critical frame rate FR2_4 corresponds to a situation that a static frame is received and the backlight mode is not activated. Besides, while a result of detecting the first frame rate FR1 by the frame rate detecting unit 144 leads to the face that the received frame is static, the image input/output unit 146 may load fixed images from the buffer 140 or 142 according to a predetermined color sequence. The predetermined color sequence may be a color sequence used under algorithms of RGBW or RGBG, so that embodiments generated by alternating the predetermined color sequence should also be regarded as embodiments of the present invention.

Similarly, while the color sequential display 100 outputs frames in forms of gray level images, since processed data of a gray level image is less than processed data of a color image, data flow of either one of the buffers 140 and 142 may be reduced as well, so that power consumption may also be achieved as a result.

Note that the input buffer 122 classifies and sorts received images into a plurality of sub-pixel groups, which include a red sub-pixel group, a green sub-pixel group, and a blue sub-pixel group in a preferred embodiment of the present invention. As shown in FIG. 1, in a preferred embodiment of the present invention, each of the buffers 140 and 142 includes a red sub-pixel buffer R, a green sub-pixel buffer G, and a blue sub-pixel buffer B, for buffering corresponding sub-pixel groups. The image input/output controlling unit 146 loads or writes different sub-pixel groups from or into the buffers 140 and 142 in units of sub-pixels, according to the frame rate detected by the frame rate detecting unit 144. Under a normal operation of the color sequential display 100, the image input/output controlling unit 146 loads sub-pixels from one of the buffers 140 and 142 and writes sub-pixels into the other one of the buffers 140 and 142 simultaneously.

Note that in other embodiments of the present invention, an amount of used buffers is not restricted to the buffers 140 and 142 shown in FIG. 1, which merely stands for one embodiment of the present invention. Note that while the image input/output controlling unit 146 loads and writes with respect to the buffers 140 and 142, the load or written sub-pixels may be included by color images or gray level images by following the images outputted by the graphics engine 160.

At last, the drive controlling unit 126 controls the data driving unit 130 and the scan driving unit 132 to manipulate activate statuses of a plurality of transistors on the displaying panel 134 according to sub-pixels load by the data controlling unit 124, i.e., by the image input/output controlling unit 146, so as to display the load sub-pixels on the display panel 134 accordingly.

Figure 2:
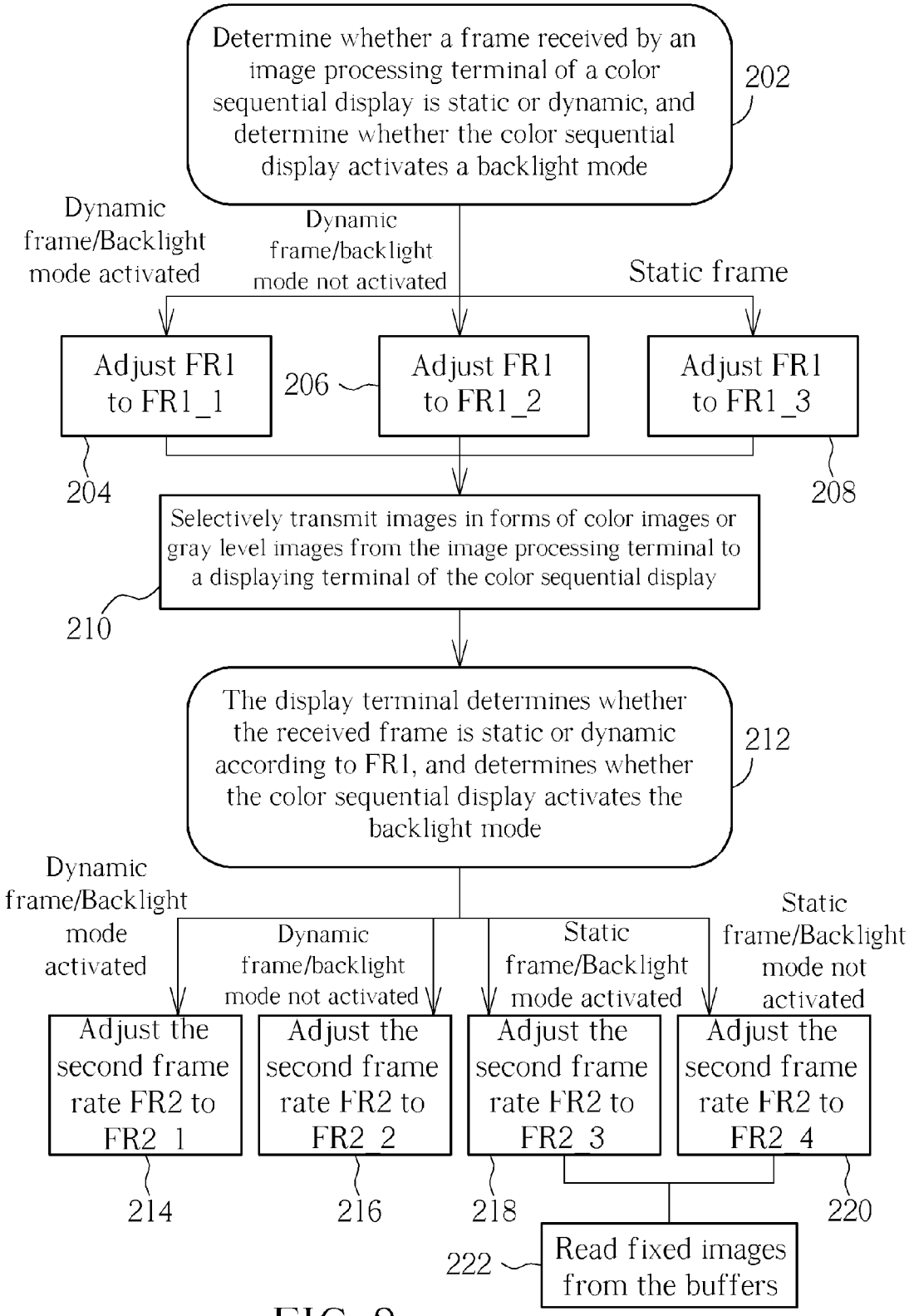
FIG. 2 illustrates a flowchart of the power saving method applied on the graphics engine 160 and the color sequential timing controller shown in FIG. 1.

Please refer to FIG. 2, which illustrates a flowchart of the power saving method applied on the graphics engine 160 and the color sequential timing controller 110 shown in FIG. 1. As shown in FIG. 2, the power saving method includes steps as follows:

Step 202: Determine whether a frame received by an image processing terminal of a color sequential display is static or dynamic, and determine whether the color sequential display activates a backlight mode; while the frame is dynamic and when the backlight mode is activated, go to Step 204; while the frame is dynamic and when the backlight mode is not activated, go to Step 206; while the frame is static, go to Step 208.

Step 204: Adjust the first frame rate FR1 to a first image processing critical frame rate FR1_1, and go to Step 210.

Step 206: Adjust the first frame rate FR1 to a second image processing critical frame rate FR1_2, and go to Step 210;

Step 208: Adjust the first frame rate FR1 to a third image processing critical frame rate FR1_3, and go to Step 210;

Step 210: Selectively transmit images in forms of color images or gray level images from the image processing terminal to a displaying terminal of the color sequential display, and go to Step 212;

Step 212: The display terminal determines whether the received frame is static or dynamic according to the first frame rate FR1, and determines whether the color sequential display activates the backlight mode; while the frame is dynamic, and when the backlight mode is not activated, go to Step 216; while the frame is static, and when the backlight mode is activated, go to Step 218; while the frame is static and when the backlight mode is not activated, go to Step 220;

Step 214: Adjust the second frame rate FR2 to a first displaying critical frame rate FR2_1;

Step 216: Adjust the second frame rate FR2 to a second displaying frame rate FR2_2;

Step 218: Adjust the second frame rate FR2 to a third displaying critical frame rate FR2_3, and go to Step 222;

Step 220: Adjust the second frame rate FR2 to a fourth displaying critical frame rate FR2_4, and go to Step 222;

Step 222: Load fixed images from the buffers.

Note that an order of the steps shown in FIG. 2 merely indicates a preferred embodiment of the present invention. However, embodiments generated by combinations and permutations of steps shown in FIG. 2 or generated by adding restrictions mentioned above should also be regarded as embodiments of the present invention.

Figure 3:
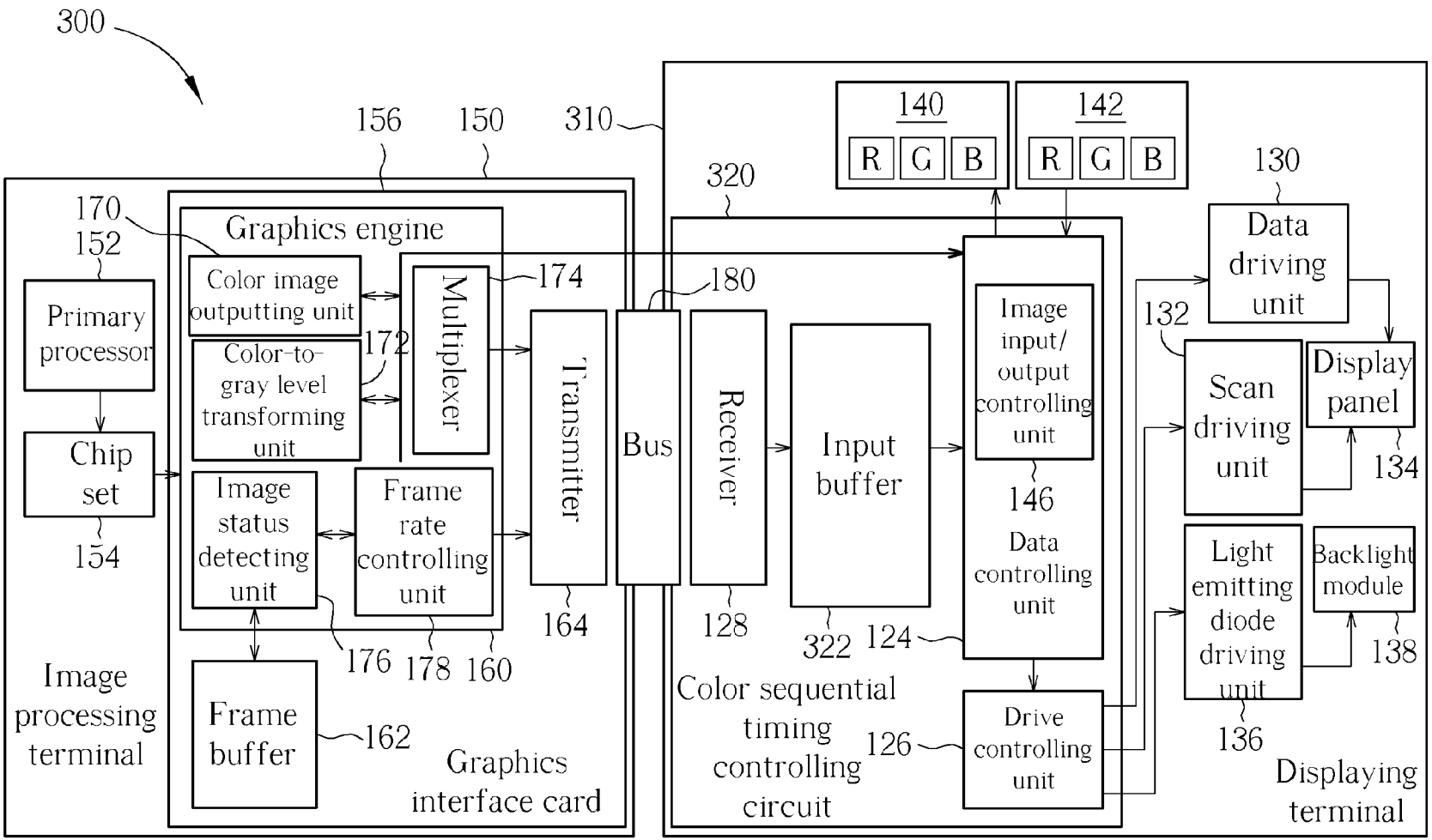
FIG. 3 is a diagram of a color sequential display according to a second embodiment of the present invention.

Please refer to FIG. 3, which is a diagram of a color sequential display 300 according to a second embodiment of the present invention. The color sequential display 300 is similar with the color sequential display 100 shown in FIG. 1, and is merely different in the characteristic that the frame rate controlling 178 of the graphics engine 160 directly controls the image input/output controlling unit 146 in an updating rate of the display panel 134, instead of controlling the image input/output controlling unit 146 with the aid of the frame rate detecting unit 144 shown in FIG. 1. For telling differences between the color sequential displays 100 and 300, the color sequential display 300 includes a displaying terminal 310, a color sequential timing controller 320, which includes an input buffer 322. Moreover, the frame rate controlling unit 178 provides a first frame rate FC1 to the image processing terminal 150 so that the image processing terminal 150 is capable of controlling an interface transmission rate of the displaying terminal 310 according to the first frame rate FC1. The Frame rate controlling unit 178 also provides a second frame rate FC2 to the image input/output processing unit 146 so that the image input/output controlling unit 146 controls the updating rate of the display panel 134 according to the second frame rate FC2. Moreover, in an other embodiment shown in FIG. 3, the frame rate controlling unit 178 directly provides control signals to the image input/output processing unit 146 so that the image input/output processing unit 146 is capable of generating the second frame rate FC2 accordingly.

Besides, the color sequential display 300 may also apply the power saving method disclosed in FIG. 2 so as to achieve the same advantages with the color sequential display 100.

Figure 4:
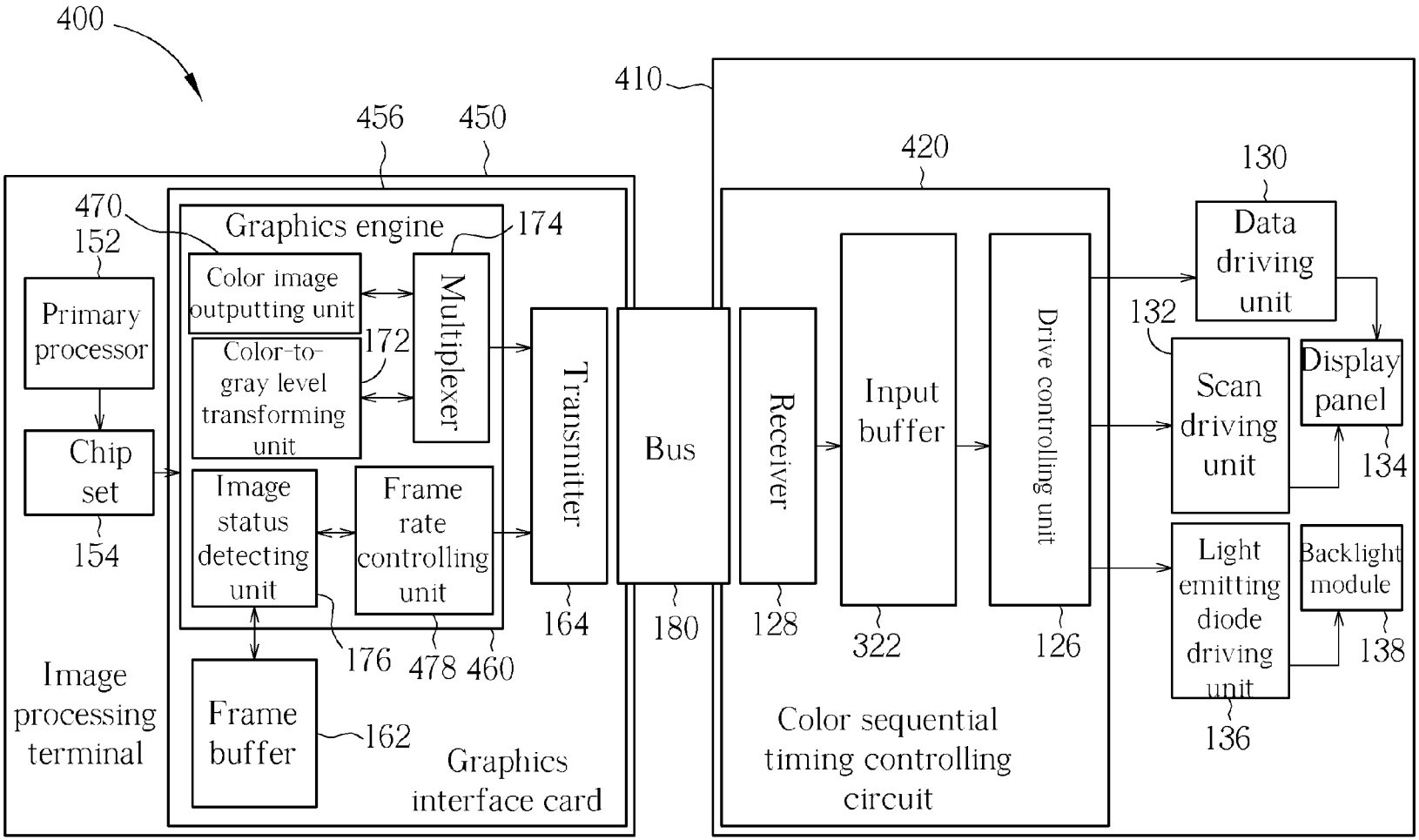
FIG. 4 is a color sequential display according to a third embodiment of the present invention.

Please refer to FIG. 4, which is a color sequential display 400 according to a third embodiment of the present invention. As shown in FIG. 4, the color sequential display 400 is similar with the color sequential displays 200 and 300, but is slightly different with the color sequential displays 200 and 300 in transmitting images in units of sub-pixels. A first difference lies in removing the buffers, the data controlling unit, and the image input/output controlling unit, and a second difference lies in using a uni-color image outputting unit 470 in replacement of the color image outputting unit 170. The uni-color image outputting unit 470 is also used for performing sorting and classifications of sub-pixel groups and inputting the sub-pixel groups into the displaying terminal through the bus 180 according to a predetermined color sequence. Besides, the frame rate controlling unit 178 is also replaced by a field rate controlling unit 478 for controlling a field rate FF used for controlling the color sequential timing controller 420. For telling differences between the color sequential display 400 and both the color sequential displays 200 and 300, the color sequential display 400 includes a displaying terminal 410 and an image processing terminal 450. The displaying terminal includes a color sequential timing controller 420. The image processing terminal 450 includes a graphics interface card 456, which includes a graphics engine 460.

While the graphics engine 460 receives images, a plurality of sub-pixel groups sorted and classified according to different colors have been generated on the uni-color image outputting unit 470 and the color-to-gray-level transforming unit 172, and an order of outputting the plurality of sub-pixel groups is scheduled according to a predetermined color sequence, for example, the exemplary order of a red sub-pixel group, a green sub-pixel group, and a blue sub-pixel group. The frame rate controlling unit 478 reduces a field rate FF for each of the plurality of sub-pixel groups, according to a result of detecting a received frame is static or dynamic, and according to whether the color sequential display 400 activates a backlight mode or not. The field rate controlling unit 478 reduces the field rate FF in a same manner with reducing the second frame rate FR2 by the image input/output controlling unit 146 shown in FIG. 1, so that related rules are simply listed as follows: (1) Reduce the field rate FF to a first image processing critical field rate FF_1, while the received frame is dynamic and when the color sequential display 400 activates the backlight mode; (2) Reduce the field rate FF to a second image processing critical field rate FF_2 or below, while the frame is dynamic and when the color sequential display 400 does not activate the backlight mode; (3) Reduce the field rate FF to a third image processing critical field rate FF_3, while the frame is static and when the color sequential display activates the backlight mode; and (4) Reduce the field rate to a fourth image processing critical field rate FF_4, while the frame is static and when the color sequential display 400 does not activate the backlight mode. Under the four conditions mentioned above, the field rate FF must be higher than zero. The first image processing critical field rate FF_1 is higher than both the second and third image processing critical field rates FF_2 and FF_3, and both the second and third image processing critical field rates FF_2 and FF_3 are higher than the fourth image processing critical field rate FF_4. In other words, the first, second, third, fourth image processing critical field rates FF_1, FF_2, FF_3, and FF_4 are all higher than zero.

Note that in similar with descriptions related to FIG. 1, in the color sequential display 400, the multiplexer 174 may also be used for selectively outputting images on forms of color images from the uni-color image outputting unit 470 or outputting images in forms of gray level images from the color-to-gray-level transforming unit 162, and power consumption may be achieved since process data in transmitting gray level images is less than processed data in transmitting color images. Besides, since the graphics engine 460 has arranged how to output the sub-pixel groups by following the predetermined color sequence, the color sequential timing controller 420 is relieved from sorting the plurality of sub-pixel groups while controlling timings of the data driving unit 130 and the scan driving unit 132.

Figure 5:
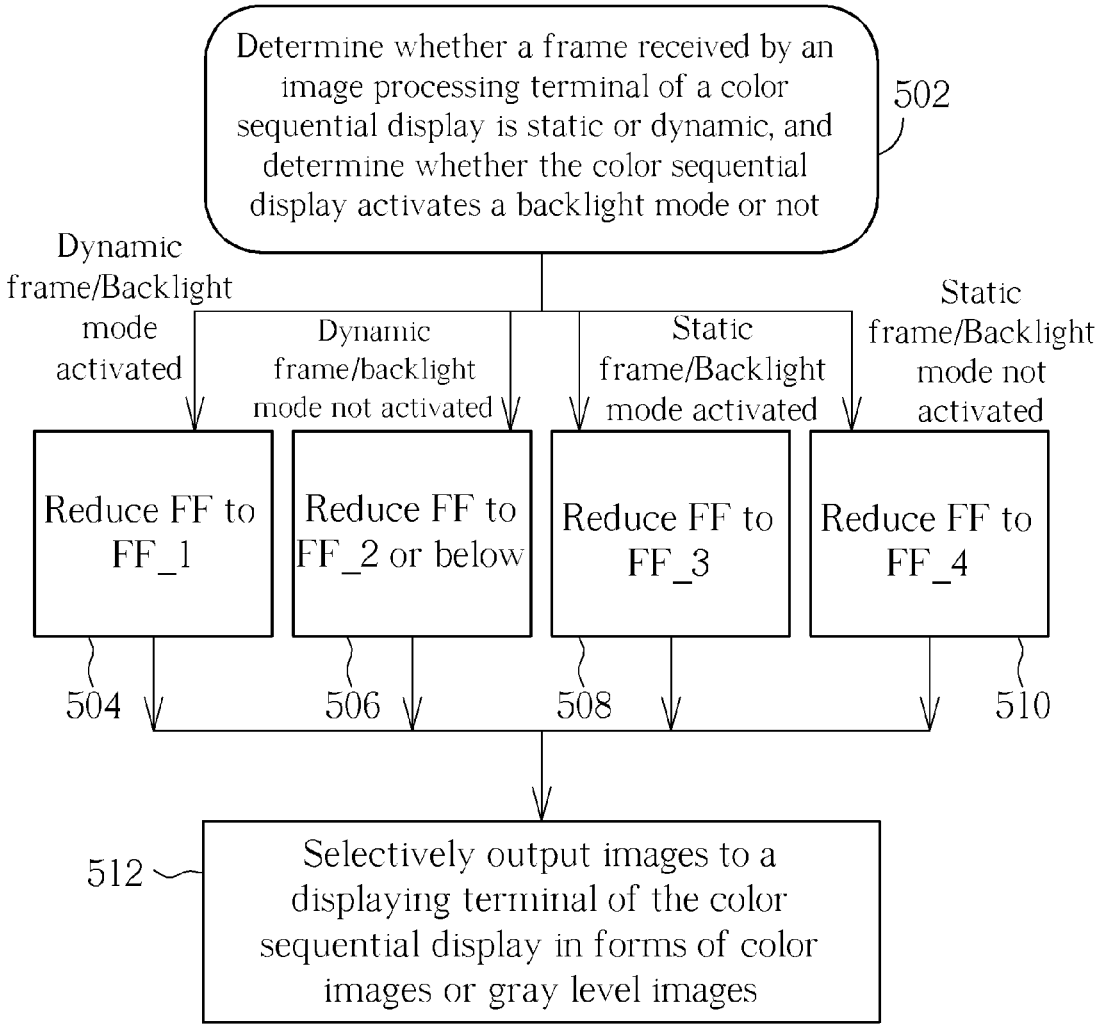
FIG. 5 is a flowchart of applying the power saving method on the color sequential display shown in FIG. 4 according to a third embodiment of the present invention.

Please refer to FIG. 5, which is a flowchart of applying the power saving method on the color sequential display 400 shown in FIG. 4 according to a third embodiment of the present invention. As shown in FIG. 5, the power saving method includes steps as follows:

Step 502: Determine whether a frame received by an image processing terminal of a color sequential display is static or dynamic, and determine whether the color sequential display activates a backlight mode or not; while the frame is dynamic and when the color sequential display activates the backlight mode, go to Step 504; while the frame is dynamic and when the color sequential display does not activate the backlight mode, go to Step 506; while the frame is static and when the color sequential display activates the backlight mode, go to Step 508; while the frame is static and when the color sequential display does not activate the backlight mode, go to Step 510;

Step 504: Reduce the field rate FF to a first image processing critical field rate FF_1, and go to Step 512;

Step 506: Reduce the field rate FF to a second mage processing critical field rate FF_2 or below, and go to Step 512;

Step 508: Reduce the field rate FF to a third image processing critical field rate FF_3, and go to Step 512;

Step 510: Reduce the field rate FF to a fourth image processing critical field rate FF_4, and go to Step 512;

Step 512: Selectively output images to a displaying terminal of the color sequential display in forms of color images or gray level images.

Note that an order of the flowchart shown in FIG. 5 merely indicates a preferred embodiment of the present invention. Embodiments generated by combinations or permutations of the steps shown in FIG. 5 or generated by adding restrictions mentioned above should also be regarded as embodiments of the present invention.

The present invention discloses some power saving methods and color sequential displays thereof. The power saving method of the present invention is primarily characterized in reducing a frame/field rate in transmitting images by determining whether a received or transmitted frame is dynamic or static, and choosing whether to transmit gray level images, which consumes smaller amounts of data and a smaller bandwidth, or not, according to whether the backlight mode of the color sequential display is activated or not, so as to effectively reducing power consumption of the color sequential display. While the color sequential display of the present invention does not display dynamic frames, the color sequential display reduces the frame/field rate according to whether the backlight mode is activated or not, and continuously loads fixed static images, so that no additional power consumption is introduced by display dynamic images. Moreover, while applying the power saving method on a portable color sequential display, both a smaller bandwidth and low power consumption are introduced so that a usage time of the portable color sequential display may be further extended under a condition that no external power is supplied. In comparison to a conventional color sequential display, the power saving method and the color sequential display thereof in the present invention may reduce processed data so to reduce data-processing complexity, and may reduce power consumption of the image processing terminal, the display terminal, or an interface between, by reducing the frame rate for transmission or the field rate in loading images. Moreover, though adding buffers in a conventional image processing terminal equipping color filters may also reduce power consumption, since the power saving method and the color sequential display thereof in the present invention may reduce processed data and transmission, the present invention may achieve better power saving than the conventional image processing terminal equipping with color filters.

Those skilled in the art will loadily observe that numerous modifications and alterations of the device and method may be made while retaining the teachings of the invention.

What is claimed is:

1. A power saving method for a color sequential display, comprising: determining whether a frame received by an image processing terminal of the color sequential display is static or dynamic; determining whether the color sequential display activates a backlight mode; and reducing a first frame rate used by a graphics engine of the image processing terminal, and reducing a second frame rate of the color sequential display in outputting frames, according to a result of whether the frame is static or dynamic and whether the backlight mode is activated, wherein reducing the first frame rate and the second frame rate according to the result of whether the frame is static or dynamic and whether the backlight mode is activated comprises: reducing the first frame rate to a first image processing critical frame rate, while the frame rate is dynamic and when the backlight mode is activated; reducing the first frame rate to a second image processing critical frame rate or below, while the frame is dynamic and when the backlight mode is not activated; and reducing the first frame rate to a third image processing critical frame rate, while the frame is static; wherein the first image processing critical frame rate is higher than the second image processing critical frame rate, and the second image processing critical frame rate is higher than the third image processing critical frame rate; wherein both the first and second image processing critical frame rates are not less than zero.

2. The method of claim 1 wherein the second frame rate is used by a buffer of the color sequential display while the buffer loads images.

3. The method of claim 1 further comprising: the graphics engine transmitting images in forms of color images while the color sequential display activates the backlight mode.

4. The method of claim 1 further comprising: the graphics engine transmitting images in forms of gray level images or color images while the color sequential display does not activate the backlight mode.

5. The method of claim 1, wherein reducing the first frame rate and the second frame rate according to the result of whether the frame is static or dynamic and whether the backlight mode is activated comprises:

reducing the second frame rate to a first displaying critical frame rate while the frame is dynamic and when the backlight mode is activated;

reducing the second frame rate to a second displaying critical frame rate or below, while the frame is dynamic and when the backlight mode is not activated;

reducing the second frame rate to a third displaying critical frame rate, while the frame is dynamic and when the backlight mode is not activated; and reducing the second frame rate to a fourth displaying critical frame rate, while the frame is static and when the backlight mode is not activated;

wherein the first displaying critical frame rate is higher than both the second and third displaying critical frame rates, and both the second and third displaying critical frame rates are higher than the fourth displaying critical frame rate;

wherein both the first and fourth displaying critical frame rate are higher than zero.

6. The method of claim 5 further comprising:

loading fixed images stored in the buffer according to a predetermined color sequence while the frame is static.

7. A color sequential display, comprising:

an image processing terminal, comprising:

an image status detecting unit, for detecting whether an image received by the color sequential display is static or dynamic; and a frame rate controlling unit, for reducing a first frame rate of a graphics engine comprised by the color sequential display according to a result of detecting the image by the image status detecting unit and according to whether the color sequential display activates a backlight mode; and a displaying terminal, comprising:

an image input/output controlling unit, for reducing a second frame rate in loading images, according to the first frame rate and according to whether the color sequential display activates the backlight mode; and a drive controlling unit, for controlling timings of a data driving unit, a scan driving unit, and a light emitting diode driving unit comprised by the color sequential display, according to the images load by the image input/output controlling unit, wherein both the data driving unit and the scan driving unit are used for controlling how pixels on a panel comprised by the color sequential display are displayed, and the light emitting diode driving unit is used for controlling whether a backlight mode of a backlight module comprised by the color sequential display is activated.

8. The color sequential display of claim 7 further comprising:

a frame rate detecting unit, for detecting the first frame rate so that the displaying terminal determines whether the image received by the color sequential display is dynamic or static according to the detected first frame rate, and for providing the detected first frame rate to the image input/output controlling unit.

9. The color sequential display of claim 7, wherein the frame rate controlling unit reduces the first frame rate to a first image processing critical frame rate, while the frame is dynamic, and when the backlight mode is activated;

wherein the frame rate controlling unit reduces the first frame rate to a second image processing critical frame rate or below, while the frame is dynamic and when the backlight mode is not activated;

wherein the frame rate controlling unit reduces the first frame rate to a third image processing critical frame rate, while the frame is static;

wherein the first image processing critical frame rate is higher than the second image processing critical frame rate, and the second image processing critical frame rate is higher than the third image processing critical frame rate;

wherein both the first and second image processing frame rates are higher than zero.

10. The color sequential display of claim 7, wherein the graphics engine transmits images in forms of color images, when the color sequential display activates the backlight mode.

11. The color sequential display of claim 7, wherein the graphics engine transmits images in forms of gray level images or color images, while the color sequential display does not activate the backlight mode.

12. The color sequential display of claim 7, wherein the image input/output controlling unit reduces the second frame rate to a first displaying critical frame rate, while the frame is dynamic and when the backlight mode is activated;

wherein the image input/output controlling unit reduces the second frame rate to a second displaying critical frame rate or below, while the image is dynamic and when the backlight mode is not activated;

wherein the image input/output controlling unit reduces the second frame rate to a third displaying critical frame rate, while the frame is static and when the backlight mode is activated; and wherein the image input/output controlling unit reduces the second frame rate to a fourth displaying critical frame rate, while the frame is static and when the backlight mode is not activated;

wherein the first displaying critical frame rate is higher than both the second and third displaying critical frame rates, and both the second and third displaying critical frame rates are higher than the fourth displaying critical frame rate;

wherein the first and fourth displaying critical frame rates are higher than zero.

13. The color sequential display of claim 12, wherein the image input/output controlling unit loads fixed images stored in a buffer comprised by the displaying terminal according to a predetermined color sequence, while the frame is static.

14. The color sequential display of claim 7 further comprising:

a color sequential timing controller, comprising:

an input buffer for synchronizing images inputted from the graphics engine, a synchronous signal inputted from an external of the color sequential timing controller, and a system clock of the color sequential timing controller, and for classifying images inputted from the graphics engine into a plurality of sub-pixel groups, each of which corresponds to different types of sub-pixels;

a data controlling unit comprising the image input/output controlling unit, the data controlling unit receives the images, which comprises the plurality of sub-pixel groups, from the input buffer;

at least one buffer, comprising a plurality of sub-pixel buffers corresponding to the plurality of sub-pixel groups one-by-one, the at least one buffer is used for loading or writing the plurality of sub-pixel groups according to control of the data controlling unit and according to a predetermined color sequence;

wherein the drive controlling unit controls timings of the data driving unit, the scan driving unit, and the light emitting diode driving unit, according to the images load from the at least one buffer, the synchronous signal, and the system clock.

15. The color sequential display of claim 14 further comprising:

a color image outputting unit comprised by the graphics engine, the color image outputting unit being used for outputting images in forms of color images, while the color sequential display activates the backlight mode;

a color-to-gray-level transforming unit comprised by the graphics engine, the color-to-gray-level transforming unit being used for selectively transforming images in forms of color images into images in forms gray level images while the color sequential display does not activate the backlight mode; and a multiplexer, for controlling whether to receive the images in forms of color images outputted from the color image outputting unit or to receive the images in forms of gray levels outputted from the color-to-gray-level transforming unit;

wherein the graphics engine is disposed within an image processing terminal of the color sequential display;

wherein a bus is disposed between the image processing terminal and the color sequential timing controller, for transmitting the images received by the multiplexer to the input buffer, and for providing the first frame rate to the color sequential timing controller.

16. The color sequential display of claim 14, wherein the input buffer comprises a frame rate detecting unit, for detecting the first frame rate of the frame rate controlling unit, and for providing the detected first frame rate to the image input/output controlling unit.

17. The color sequential display of claim 14, wherein the input buffer comprises a frame rate detecting unit, for detecting transmitted information of the frame rate controlling unit, and for providing a result of detecting the transmitted information to the image input/output controlling unit.

18. The color sequential display of claim 7 wherein the frame rate controlling unit generates a frame rate controlling signal according to the first frame rate, and transmits the frame rate controlling signal to the image input/output controlling unit, so that the image input/output controlling unit determines the second frame rate according to the first frame rate for loading images stored in at least one buffer comprised by the color sequential display.

19. A power saving method of a color sequential display, comprising: determining whether a frame received by an image processing terminal comprised by the color sequential display is static or dynamic; determining whether the color sequential display activates a backlight mode or not; transforming images of the received frame into a plurality of sub-pixel groups, each of which corresponds to a different color; and respectively reducing a field rate of transmitting each of the plurality of sub-pixel groups by the image processing terminal, according to a result of determining the frame is static or dynamic and according to a result of determining whether the color sequential display activates the backlight mode or not, wherein respectively reducing the field rate for transmitting each of the plurality of sub-pixel groups according to the result of determining the frame is static or dynamic and according to the result of determining whether the color sequential display activates the backlight mode or not comprises: reducing the field rate to a first image processing critical field rate, while the frame is dynamic and when the backlight mode is activated; reducing the field rate to a second image processing critical field rate or below, while the frame is dynamic and when the backlight mode is not activated; and reducing the field rate to a third image processing critical field rate while the frame is static; wherein the first image processing critical field rate is higher than the second image processing critical field rate, and the second image processing critical field rate is higher than the third image processing critical field rate; wherein both the first and second image processing critical field rates are higher than zero.

20. The method of claim 19 further comprising:

transmitting images from the image processing terminal to the displaying terminal in forms of color images while the color sequential display activates the backlight mode.

21. The method of claim 19 further comprising:

transmitting images from the image processing terminal to the displaying terminal in forms of gray level images while the color sequential display activates the backlight mode.

22. The method of claim 19 further comprising:

loading fixed images stored by a buffer comprised by the color sequential display according to a predetermined color sequence, while the frame is static.

23. A color sequential display, comprising:

an image status detecting unit, for detecting whether a frame received by the color sequential display is static or dynamic;

a field rate controlling unit, for respectively reducing a field rate for transmitting each of a plurality of sub-pixel groups by an image processing terminal, according to a result of detecting the frame by the image status detecting unit;

an uni-color image outputting unit, for transmitting images of the frame into a plurality of sub-pixel groups, and outputting the plurality of sub-pixel groups according to a predetermined color sequence, while the color sequential display activates a backlight mode; and a color-to-gray-level transforming unit, for selectively transforming the plurality of sub-pixel groups from forms of color images into forms of gray level images, and for outputting the plurality of transformed sub-pixel groups according to the predetermined color sequence, while the color sequential display does not activate the backlight mode;

wherein images outputted by the uni-color image outputting unit and the color-to-gray-level transforming unit are received and transmitted by a bus.

24. The color sequential display of claim 23 further comprising:

a color sequential timing controller, comprising:

an input buffer, for buffering each sub-pixel group transmitted by the bus, and for synchronizing both a synchronous signal externally inputted to the color sequential timing controller and a system clock of the color sequential timing controller; and a drive controlling unit, for controlling timings of a data driving unit, a scan driving unit, and a light emitting diode driving unit of the color sequential display, according to the buffered images of the input buffer, wherein the data driving unit and the scan driving unit are used for controlling how pixels on a panel of the color sequential display are displayed, and the light emitting diode driving module is used for controlling a backlight module of the color sequential display so as to determine whether the backlight mode is activated or not;

wherein the bus is disposed between the image processing terminal and the color sequential timing controller, for transmitting the plurality of sub-pixel groups to the bus, and for providing the field rate reduced by the field rate controlling unit and each the sub-pixel group transmitted by the bus to the color sequential timing controller.

25. The color sequential display of claim 23, wherein the field rate controlling unit reduces the field rate to a first displaying critical field rate, while the frame is dynamic and when the backlight mode is activated;

wherein the field rate controlling unit reduces the field rate to a second displaying critical field rate or below, while the frame is dynamic and when the backlight mode is not activated;

wherein the field rate controlling unit reduces the field rate to a third displaying critical field rate, while the frame is static and when the backlight mode is activated;

wherein the field rate controlling unit reduces the field rate to a fourth displaying critical field rate, while the frame is static and when the backlight mode is not activated;

wherein the first displaying critical field rate is higher than both the second and third displaying critical field rates, and both the second and third displaying critical field rates are higher than the fourth displaying critical field rate;

wherein both the first and fourth displaying critical field rates are higher than zero.

26. The color sequential display of claim 23 further comprising:

a multiplexer, for controlling whether receiving the plurality of sub-pixel groups outputted from the uni-color image outputting unit or receiving the selectively-outputted plurality of sub-pixel groups from the color-to-gray-level transforming unit, and transmitting each of the plurality of received sub-pixel groups to the bus.

* * * * *